US007158612B2

(12) United States Patent
Rusch et al.

(10) Patent No.: US 7,158,612 B2
(45) Date of Patent: Jan. 2, 2007

(54) ANODE ASSEMBLY FOR AN X-RAY TUBE

(75) Inventors: Thomas W. Rusch, Santa Clara, CA (US); Peter C. Smith, Half Moon Bay, CA (US); Steven D. Hansen, San Jose, CA (US); Paul A. Lovoi, Saratoga, CA (US); Donald G. Pellinen, Livermore, CA (US)

(73) Assignee: Xoft, Inc., Fremont, CA (US)

( * ) Notice: Subject to any disclaimer, the term of this patent is extended or adjusted under 35 U.S.C. 154(b) by 138 days.

(21) Appl. No.: 10/371,401

(22) Filed: Feb. 21, 2003

(65) Prior Publication Data

US 2004/0165699 A1 Aug. 26, 2004

(51) Int. Cl.
*H01J 35/32* (2006.01)
*H01J 35/20* (2006.01)

(52) U.S. Cl. ..... 378/121; 378/123

(58) Field of Classification Search ..... 378/64, 378/65, 119, 121, 122, 123, 140, 143
See application file for complete search history.

(56) References Cited

U.S. PATENT DOCUMENTS 3,584,219 A 6/1971 Herglotz et al.
3,665,236 A * 5/1972 Gaines et al. ..... 378/138
3,892,989 A * 7/1975 Gralenski et al. ..... 378/138
4,143,275 A 3/1979 Mallozzi et al.
4,159,437 A * 6/1979 Sahores ..... 378/140
4,229,657 A * 10/1980 Bensussan et al. ..... 378/125
4,431,709 A * 2/1984 Bronnes et al. ..... 428/649
5,090,043 A * 2/1992 Parker et al. ..... 378/121
5,153,900 A 10/1992 Nomikos et al.
5,157,704 A * 10/1992 Harding ..... 378/119
RE34,421 E 10/1993 Parker et al.
5,329,569 A * 7/1994 Spielman ..... 378/161
5,369,679 A 11/1994 Sliski et al.
5,422,678 A 6/1995 Takeuchi
5,422,926 A 6/1995 Smith et al.
5,428,658 A * 6/1995 Oettinger et al. ..... 378/119
5,452,720 A 9/1995 Smith et al.
5,509,045 A * 4/1996 Kautz ..... 378/123
5,528,652 A 6/1996 Smith et al.
5,566,221 A 10/1996 Smith et al.
RE35,383 E 11/1996 Miller et al.
5,621,780 A 4/1997 Smith et al.
5,729,583 A * 3/1998 Tang et al. ..... 378/122
6,064,718 A * 5/2000 Holland et al. ..... 378/122
6,095,966 A 8/2000 Chornenky et al.
6,134,299 A * 10/2000 Artig ..... 378/121

(Continued)

FOREIGN PATENT DOCUMENTS

WO PCT/US96/3629 8/1996

*Primary Examiner*—Allen C. Ho
(74) *Attorney, Agent, or Firm*—Thomas M. Freiburger

(57) ABSTRACT

A miniature x-ray tube has an anode assembly capable of transmitting x-rays through the anode and over a wide angular range. The anode is in the shape of a cone or truncated cone with an axis on the x-ray tube frame axis, formed of low-Z material with high thermal conductivity for heat dissipation. A target material on the anode body is in a thin layer, which may be approximately 0.5 to 5 microns thick. In one embodiment a tube evacuation exhaust port at the tail end of the anode assembly forms a cavity for a getter, with a pinched-off tubulation at the end of the cavity.

67 Claims, 11 Drawing Sheets

U.S. PATENT DOCUMENTS 6,134,300 A 10/2000 Trebs et al.
6,154,521 A * 11/2000 Campbell ..... 378/125
6,195,411 B1 * 2/2001 Dinsmore ..... 378/65
6,319,188 B1 11/2001 Lovoi
6,353,658 B1 * 3/2002 Trebes et al. ..... 378/123
6,580,780 B1 * 6/2003 Miller ..... 378/141
6,721,392 B1 * 4/2004 Dinsmore ..... 378/65
6,799,075 B1 * 9/2004 Chornenky et al. ..... 607/117

* cited by examiner

ANODE ASSEMBLY FOR AN X-RAY TUBE

BACKGROUND OF THE INVENTION

This invention concerns an anode assembly for an x-ray tube, and especially a miniature x-ray tube.

X-ray tubes are described in U.S. Pat. Nos. 4,143,275, 5,153,900, 5,428,658, 5,422,926, 5,422,678, 5,452,720, 5,621,780, RE 34,421 and 6,319,188, some of which pertain to miniature x-ray tubes. The term miniature x-ray tube as used herein is intended to mean an x-ray tube of about 10 mm. diameter or less, useful for therapeutic and diagnostic medical purposes, and materials analysis, among other uses.

The anode of an x-ray tube is a critical element. For a number of applications the anode should transmit x-rays through itself to provide a wide angular range for emission of x-rays from the tube, rather than emitting the x-rays only in the generally radial direction.

Xoft microTube U.S. Pat. No. 6,319,188, referenced above, describes a miniature x-ray tube in which the anode is generally flat, with provision for x-ray emission through various angular ranges in different embodiments.

Other patents having some relevance to this invention include U.S. Pat. Nos. 3,584,219, 5,369,679, 5,528,652, 5,566,221, RE 35,383, 6,095,966, 6,134,300, and Int'l Pub. WO 97/07740.

It is an object of this invention to improve the geometry and the structure of an anode assembly in an x-ray tube, providing a wide angle of emission, without compromising x-ray output, seal integrity or efficiency, and to provide an efficient placement for a getter, necessary for tube longevity.

SUMMARY OF THE INVENTION

In a preferred embodiment of the invention an x-ray tube has a tube frame, a cathode assembly and an anode assembly, with the anode assembly comprising a transmission anode with a conical target coaxial with the tube or frame. The conical target has its concave side receiving the beam of electrons from the cathode located at the opposed end of the tube. Formed of low atomic number (low-Z), high thermal conductivity material, the anode is highly transmissive of x-ray radiation and supports a thin target film that may be about one-half to five microns thick.

In one embodiment the anode is a complete cone with an apex at the end most distant from the cathode. The anode housing preferably is rounded or bullet shaped at the exterior, with the cone formed as the interior surface of the anode body, and comprising the anode itself in the event the anode body is electrically conductive. A target preferably comprising a thin film is deposited on the conical surface, and, if the anode body is not electrically conductive, the target must be a conductive material and have a conductive path to the exterior surface of the anode body.

A getter advantageously may be housed in the anode assembly. For this purpose an annular expanded area or recess in the anode assembly interior, proximal to the cone, can contain a cylindrical getter. Evacuation of the x-ray tube can be by processing and final sealing of the tube in a vacuum chamber, or through an evacuation port located elsewhere on the tube assembly.

The anode body material can be beryllium, diamond, aluminum nitride, silicon or other low-Z, highly thermally conductive material, while the anode thin film target material can be platinum, god, tungsten, etc. Additionally, these materials are electron tube compatible and sealable. The low-Z body and the conical shape provide for x-ray emission virtually omnidirectionally around the dome-shaped end of the anode, including the axial direction, if desired.

In a second embodiment the anode assembly has a cone-shaped interior wall, but with an axial hole where the cone apex would be, leading to a cavity for a getter material and an evacuation port. In one form of this arrangement, the anode assembly has, at the proximal end, a cylindrical cavity for connection to the remainder of the interior cavity of the tube frame, and the anode assembly's cylindrical cavity leads to a tapered end, i.e. the cone serving as the anode. Just distal from the hole in the cone is a passage leading to a cavity or chamber for the getter material. A tubulation in this embodiment is sealed to the end of the anode body, and the tubulation itself can form a continuation of the getter chamber. The distal end of this tubulation is pinched off after evacuation.

In a third embodiment the anode with conical interior surface and the tube frame are formed as an integral assembly that eliminates the need to join the anode and frame during the x-ray tube fabrication process. This integrated anode and frame structure can contain an interior cavity for the getter material or may have an evacuation port with tubulation that forms a continuation of the getter chamber. Evacuation of an x-ray tube of this embodiment can be performed by assembly of the tube in a vacuum chamber, or through an exhaust port located on the assembly.

In a fourth embodiment a tubulation assembly for providing exhaust is sealed together on one end with the tube frame and on the opposite end with the anode with conical interior surface, thereby providing a completed x-ray tube cavity. This tubulation assembly may also provide an interior cavity for the getter material. Evacuation of an x-ray tube of this embodiment can be performed through an exhaust port located on the tubulation assembly.

It is thus among the principal objects of the invention to provide an efficient anode structure on an x-ray tube, and particularly on a miniature x-ray tube, wherein a getter is efficiently contained and the anode structure allows nearly omnidirectional x-ray emission from the distal end of the assembly. These and other objects, advantageous and features of the invention will be apparent from the following description of preferred embodiments, considered along with the drawings.

DESCRIPTION OF PREFERRED EMBODIMENTS

Figure 1:
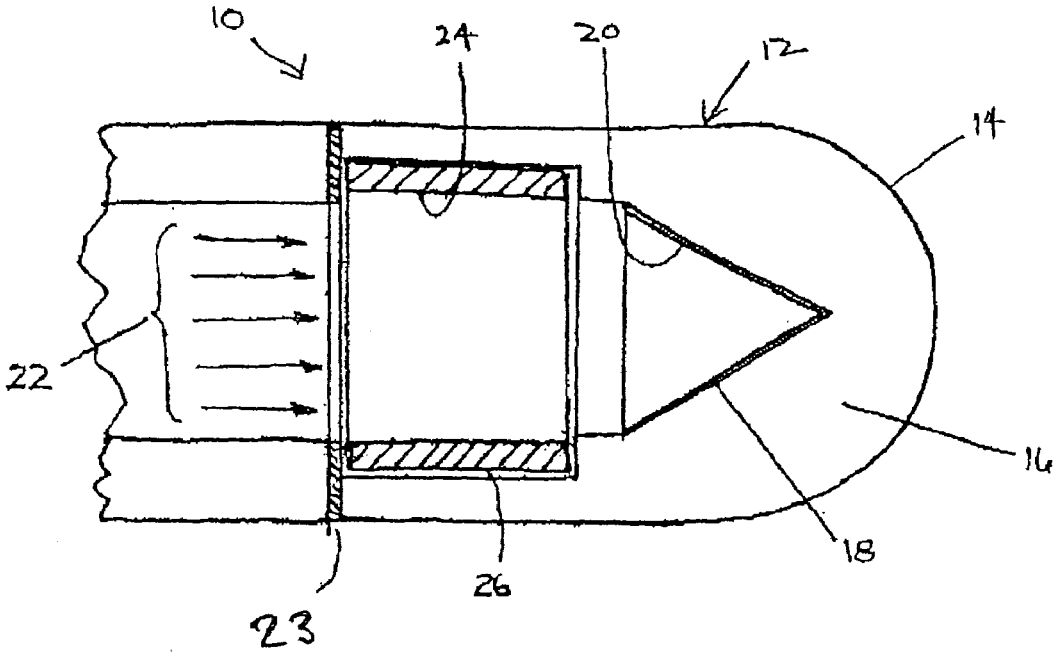
FIG. 1 is a side elevation view in cross section, showing a portion of an x-ray tube assembly at the anode end.

In the drawings, FIG. 1 shows a portion of an x-ray tube assembly 10, including an anode end 12 according to the invention. The anode assembly 12, in this embodiment, has a bullet-shaped, dome-shaped or generally hemispherical or rounded distal end 14 formed by an anode body 16 that comprises a low-Z, high thermal conductivity material. Examples are beryllium, beryllium oxide, boron nitride, aluminum nitride, silicon nitride, diamond or aluminum oxide. Other desirable materials are alloys of aluminum or beryllium or combinations thereof. Such a material provides very little barrier to x-ray emission, while still allowing heat efficiently to be conducted away from the anode assembly and from the x-ray tube. The body material is nearly transparent to x-rays.

This anode body 16 has an internal surface 18 which is conical or essentially conical, and coated with a thin film target 20 for producing x-rays when bombarded by electrons. The conical shape, as compared to a hemispherical shape, has the advantage that all portions of an electron beam 22 strike the anode surface at essentially the same angle. This creates a more reproducible output of x-rays, as compared to a hemispherical or other shape in which different distances of the electron beam away from the tube axis change the angle of incidence significantly. The conical anode is similarly less sensitive to changes in the electron beam shape. "Conical" as used herein includes both a substantially complete cone, with an apex, and a truncated cone. In a preferred embodiment operating with an electron beam energy of 45 kV, the apex included angle of the cone is 60 degrees. The cone angle can be optimized for operation at specific electron beam energies or for a range of electron beam energies, such as 20 to 50 keV.

The thin film target 20 on the anode comprises a material coated or deposited on the conical internal surface 18. Such a thin film material can be platinum, gold, tungsten, etc., high-Z materials well known to emit x-rays in response to electron bombardment. The thin film target can also be a low-Z material such as titanium, chromium, copper, etc., for specialized x-ray tube applications that require specific x-ray spectral distributions. The thin film target thickness can be in the range from about 1 to 5 microns, more preferably about 0.5 to 5 microns depending upon the target material, the electron beam energy, and the desired x-ray spectral and spatial distributions. In one preferred embodiment, the thin film target comprises platinum about 2 microns thick. In another specific embodiment the target thin film comprises a first layer of titanium plus tungsten that is 0.1 microns thick (a base layer for adhesion) and a second layer of gold that is 1 micron thick. In general, the thin film target comprises one or more substances with atomic number greater than 19. Selection of an anode cone angle and thin film target comprising two to five layers of different thickness and composition allows the x-ray spatial distribution and energy to be tailored for operation over a range of electron beam energies, such as 20 to 70 keV.

If the anode body 16 is not electrically conductive, the thin film target 20 serves as the conductive anode. Electrical connection to the thin film target 20 can be via an electrically conductive anode-frame seal 23 and an internal coating in the anode body, or it can be through a hole from the internal surface 18 to the exterior, filled with a conductor. This applies to all embodiments.

The configuration of the anode assembly 12, whether the internal surface 18 is conical or not, provides an efficient location for placing a getter 24 within the x-ray tube, with a significant active volume of the getter. FIG. 1 shows the getter 24 as a cylindrical annular piece, housed in a cylindrical or annular recess 26 within the anode assembly, preferably formed as a recess in the anode body as shown. The ring-shaped getter 24 can be relatively large in both area and volume, as compared to a getter pellet of solid configuration, occupying a central space or other space in the tube. The x-ray tube of the invention preferably is a miniature x-ray tube, and the additional getter area and volume can be an important consideration for improving x-ray tube lifetime by reducing the internal tube pressure.

Figure 2C:
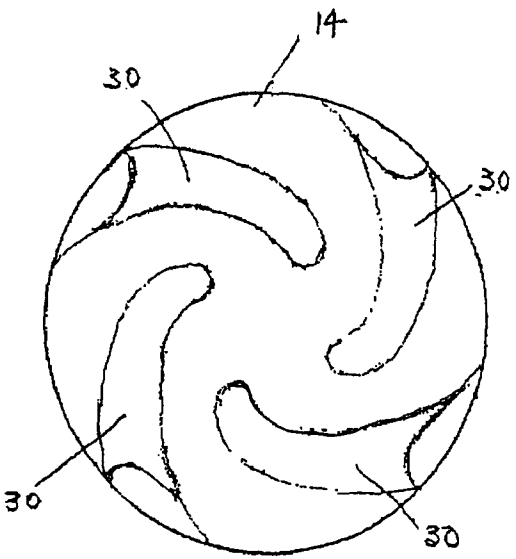
FIGS. 2A, 2B and 2C are axial views of the anode distal end, showing three alternative surface contours.
Figure 2B:
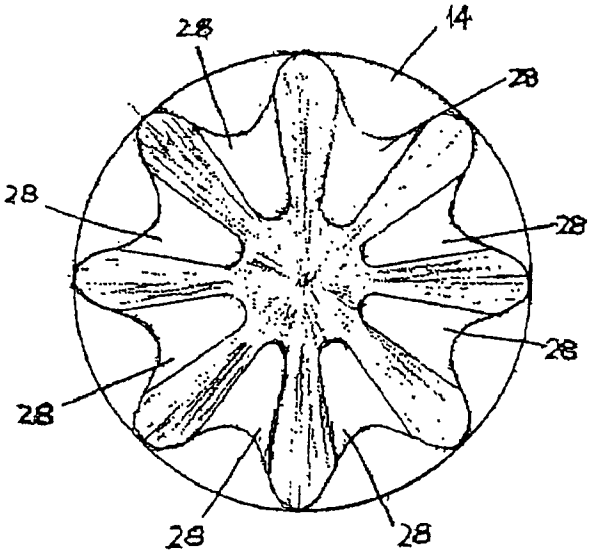
Figure 2A:
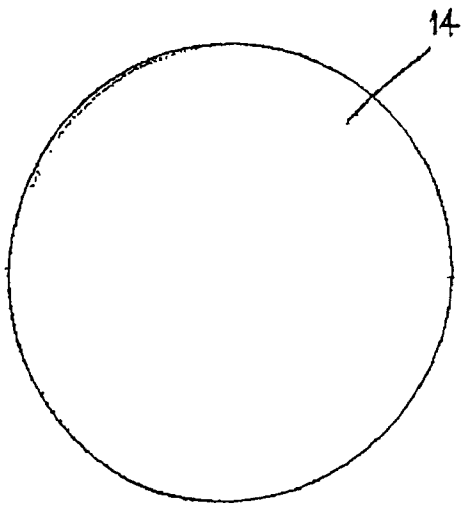

FIG. 2A is an axial view of the distal end 14 of the anode assembly 12, the end having a smooth outer surface. FIG. 2B shows an axial view of an alternative distal end 14 that has enhanced surface area to improve the heat transfer efficiency. The surface area can be increased by adding straight grooves or convolutions 28 to the substantially hemispherical end form as shown in FIG. 2B, or by adding spiral grooves or convolutions 30 as shown in FIG. 2C. The number and shape of grooves or convolutions can be varied significantly while still increasing the heat transfer efficiency.

Figure 3:
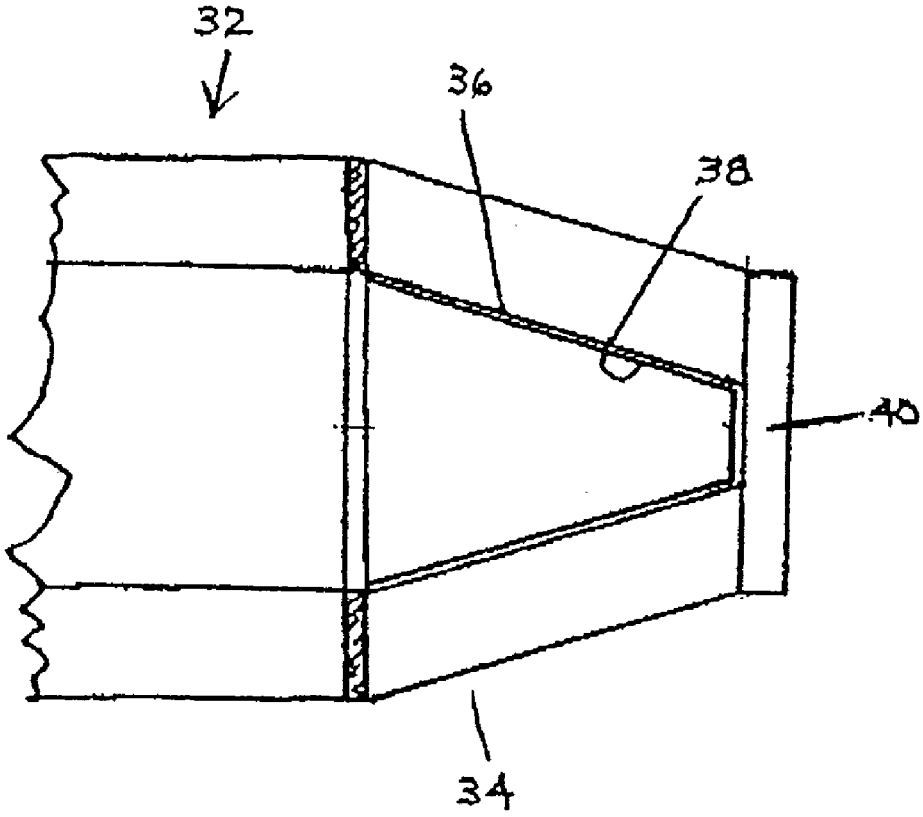
FIG. 3 is an elevational cross sectional view showing a portion of an x-ray tube of another embodiment, again including the anode end.

FIG. 3 shows a portion of an x-ray tube assembly 32 with a different anode assembly 34, but still including an internal surface 36 defining a portion of a cone. In this anode assembly, the thin film target 38 extends from the conical internal surface 36 and across an end window 40. The purpose of this arrangement is to increase the x-ray flux out of the x-ray tube, preferably a miniature x-ray tube. The anode essentially is elongated, and terminated with the end window 40. X-rays generated in the thin film target 38 on the conical internal surface 36, as well as the end window 40, can be emitted over a wide angular range, including the axial direction, when desired. This truncated conical structure can also be achieved in an anode body fabricated from a single piece of material.

Figure 4:
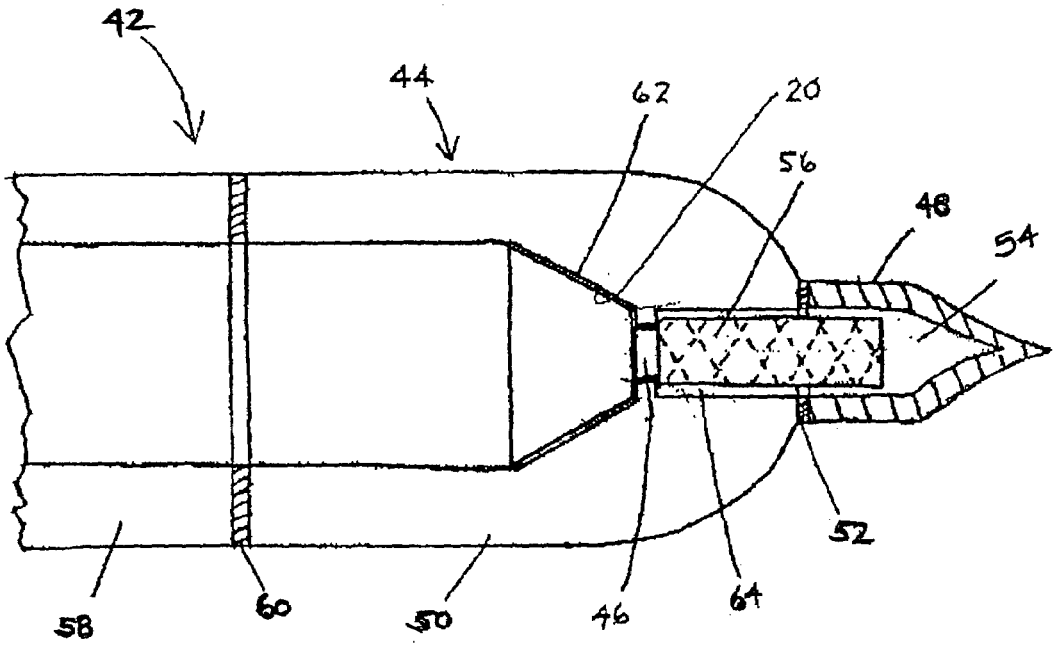
FIG. 4 is a side elevation view in cross section showing a further embodiment of an x-ray tube, showing the anode end.

FIG. 4 shows in cross-section a portion of an x-ray tube assembly 42 comprising another important embodiment of this invention. This form of the invention preferably is embodied in a miniature x-ray tube, with an external diameter on the order of about 1 mm, although similar construction can be applied to a larger tube. An anode assembly 44, is shown at the distal end of the x-ray tube, and terminated with an evacuation port 46 and tubulation 48 preferably comprising copper, shown pinched off in the drawing. The anode assembly's principal component is an anode body 50 formed of a low-Z, high thermal conductivity material such as beryllium, beryllium oxide, boron nitride, aluminum nitride, silicon nitride, diamond, aluminum oxide, or aluminum-beryllium alloy, and having an axial hole as shown. The use of the aluminum nitride provides for efficient fabrication and sealing with acceptable x-ray transmissivity and thermal conductivity. One additional benefit for many applications is that the aluminum nitride provides greater low-energy x-ray absorption than a material such as beryllium or diamond; this is desired where radiation dosage is best administered with high-energy x-rays only. The tube frame 58 is sealed to the anode assembly 44 at anode-frame seal 60. This seal in a preferred embodiment is achieved by brazing, using a material such as Cusil ABA, a copper-silver active metal braze alloy. As an alternative, an intermediate material such as Kovar, molybdenum or tantalum can be used, with thermal expansion properties between those of the anode body 50 and the tube frame 58. The anode-frame seal 60 may comprise braze material plus a Kovar, molybdenum or tantalum washer, heated to brazing temperature to make a high integrity seal between the two components.

This anode body may be tapered to a smaller diameter or rounded at its distal end as shown in FIG. 4. The distal end of the anode body 50 meets the tubulation 48 at a tubulation seal 52, which can be a copper-silver active metal alloy bond, if the tubulation 48 is formed of copper. As shown, in this embodiment the anode assembly 44 along with the tubulation 48 forms a getter cavity 54 to contain a getter 56. This getter 56 may be in pellet form as shown in FIG. 4 or may be a strip or ring.

All of the assembled components in FIGS. 1, 3 and 4 are axially symmetric. However, the tubulation 48 can be placed at other locations on the anode body.

In FIG. 4, the anode assembly 44 has a truncated conical internal surface 62 that terminates at an evacuation port 46. A thin film target 20 coated on the conical internal surface 62 comprises the anode itself. The evacuation port 46 opens to a larger diameter passageway 64 in the embodiment shown, forming the getter cavity 54 in combination with the tubulation 48.

Figure 5A:
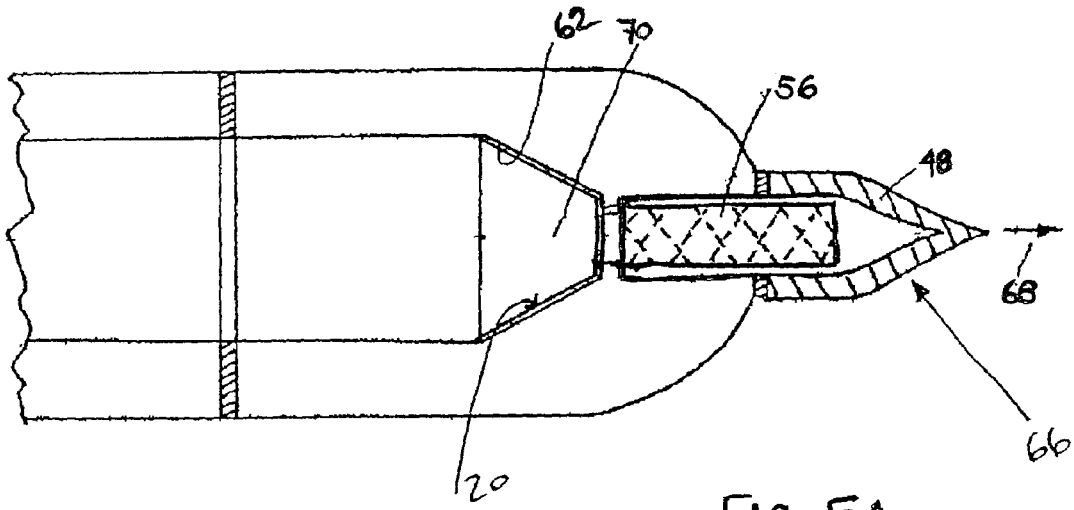
FIGS. 5A and 5B are side cross-sectional views of the FIG. 4 embodiment that show x-ray emission blockage in two separate configurations.
Figure 5B:
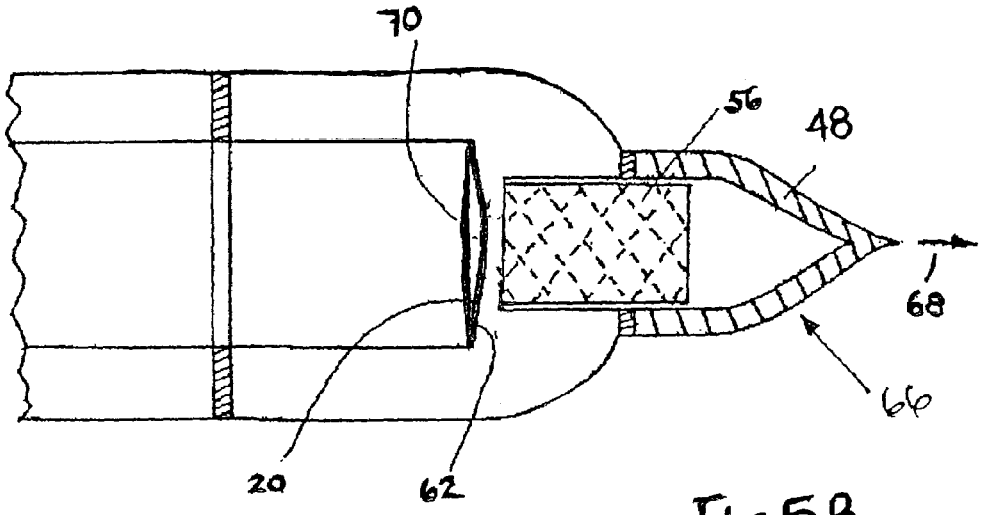

The getter location can provide an added benefit for certain applications such as x-ray treatment in blood vessels or other lumens. Often it is important to prevent x-ray transmission from the distal end 66 of the tube along the axial direction 68. As shown in FIG. 5A, the getter 56 and tubulation 48 to some extent shadow the x-rays from emission in the strictly axial direction 68. The getter 56 and tubulation 48 can have minimal diameter if minimal axial blocking is desired, the shadowed region 70 being shown as a narrow cone along the axis. X-rays are emitted from all portions of the target. The distribution of X-rays emitted can be tailored to be more isotropic or more specialized depending on the requirement of the application. A distal axially-incorporated getter can substantially modify the radiation distribution in the forward direction, by tailoring the getter's radial and axial extent. FIG. 5B shows that by increasing the angle of the conical internal surface that supports the thin film target 20 as well as increasing the diameter of the tubulation 48 and getter 56, the forward distribution of radiation is reduced to a greater and wider extent.

Figure 6:
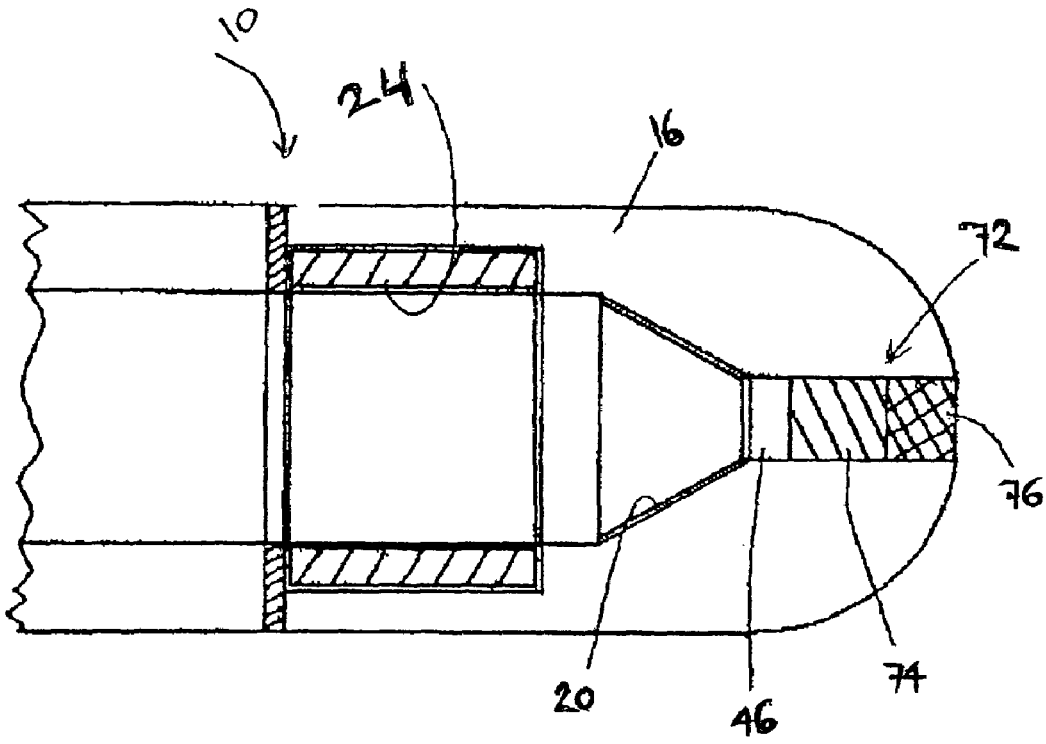
FIG. 6 is a side cross-sectional view showing a further embodiment of the x-ray tube with an axial anode seal.

FIG. 6 shows another embodiment that includes an anode seal 72 incorporated directly into the anode body 16 to seal the evacuation port 46 after processing the x-ray tube. The anode seal 72 can be formed from a single material such as indium or gold or it can be formed from two materials as shown in FIG. 6. Use of two materials provides more flexibility to shape the x-ray emission pattern from the anode. A high-Z anode plug 74 such as gold, can prevent x-ray transmission along the tube axis and a separate material, such as indium can provide a hermetic seal 76. The high-Z anode plug 74 and hermetic seal 76 may also be used for electrical contact to the thin film target 20 if the anode body 16 comprises a non-conductive material such as beryllium oxide, boron nitride, aluminum, nitride, silicon nitride, diamond or aluminum oxide.

By fabricating an anode body with non-uniform composition, one or more benefits can result. First, changing the percentage of a higher-Z element with position in the anode body can modify the x-ray emission spatial distribution and/or energy distribution. Second, varying the composition of the anode body can modify the thermal expansion coefficient thereby improving the ability to join the anode to disparate frame and tubulation materials. Third, the thermal conductivity of the anode can be tailored with composition to provide a more efficient heat transfer profile. Aluminum nitride may be combined with different concentrations of sintering materials such as magnesium oxide, calcium oxide, samarium oxide, or other rare earth oxides to achieve such graded compositions.

Figure 7A:
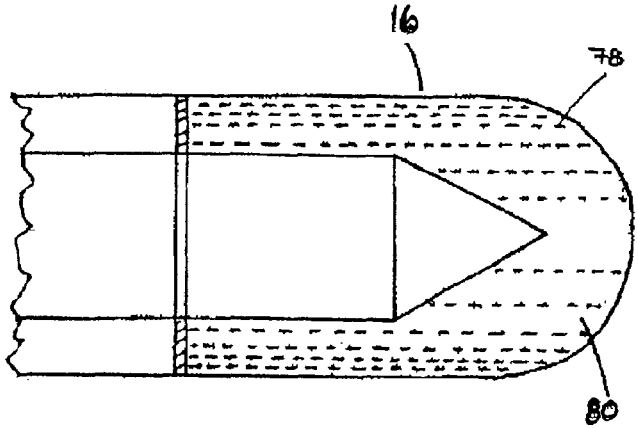
FIGS. 7A and 7B are side cross-sectional views, indicating composition gradients in the anode body.
Figure 7C:
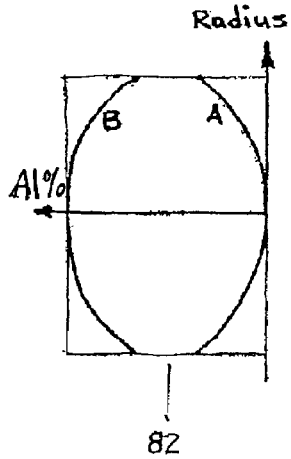
FIGS. 7C and 7D are companion graphs indicating the composition gradients in FIGS. 7A and 7B, respectively.

FIG. 7A shows an anode body 16 composed of constituent A 78 distributed through constituent B 80 with a radial composition gradient shown schematically in the accompanying chart 82 of FIG. 7C. In the chart 82 atomic number is shown as a percentage varying with radius. The dashed lines in FIG. 7A represent the concentration variation of constituent A 78. In FIG. 7A, the concentration of constituent A is higher on the anode surface and decreases toward the central axis. This type of gradient could be desirable to shape the x-ray distribution.

Figure 7D:
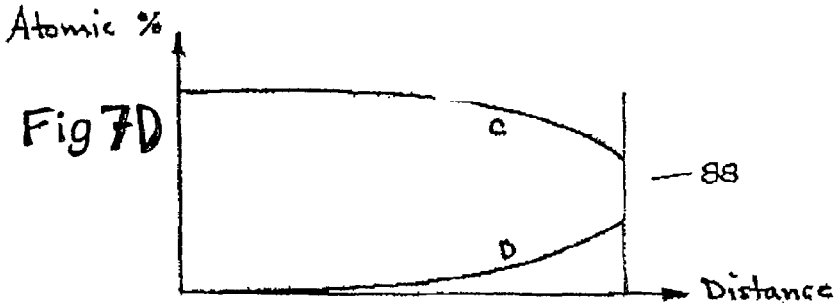
Figure 7B:
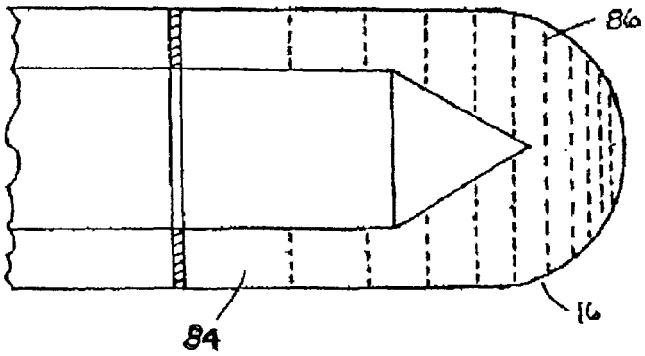

FIG. 7B shows an anode body 16 composed of constituent C, 84 and constituent D 86 with an axial composition gradient shown schematically in the accompanying chart 88 of FIG. 7D. In the chart 88 atomic number is shown as a percentage varying with axial position. The dashed lines in FIG. 7B represent the concentration variation of constituent D 86. This axial composition gradient could be obtained, for example, by physical or chemical vapor deposition, or sequential deposition from a melt or slurry. The concentration of constituent C 84 is higher on the proximal end of the anode body and decreases toward the distal end. This type of gradient could be desirable to modify the thermal expansion coefficient or the thermal conductivity as well as the x-ray distribution.

Although the examples in FIGS. 7A and 7B refer to two constituents, these concepts can be realized with more than two elements.

As an alternative to the gradients shown in FIGS. 7A–7D, shaping of the x-ray emission pattern and average x-ray emission energy can be accomplished by selective coating of the exterior of the anode body. For example, physical or chemical vapor deposition of a low-Z element like aluminum nitride with one or more elements such as silver with Z equal to or greater than 19 can achieve this purpose.

Figure 8:
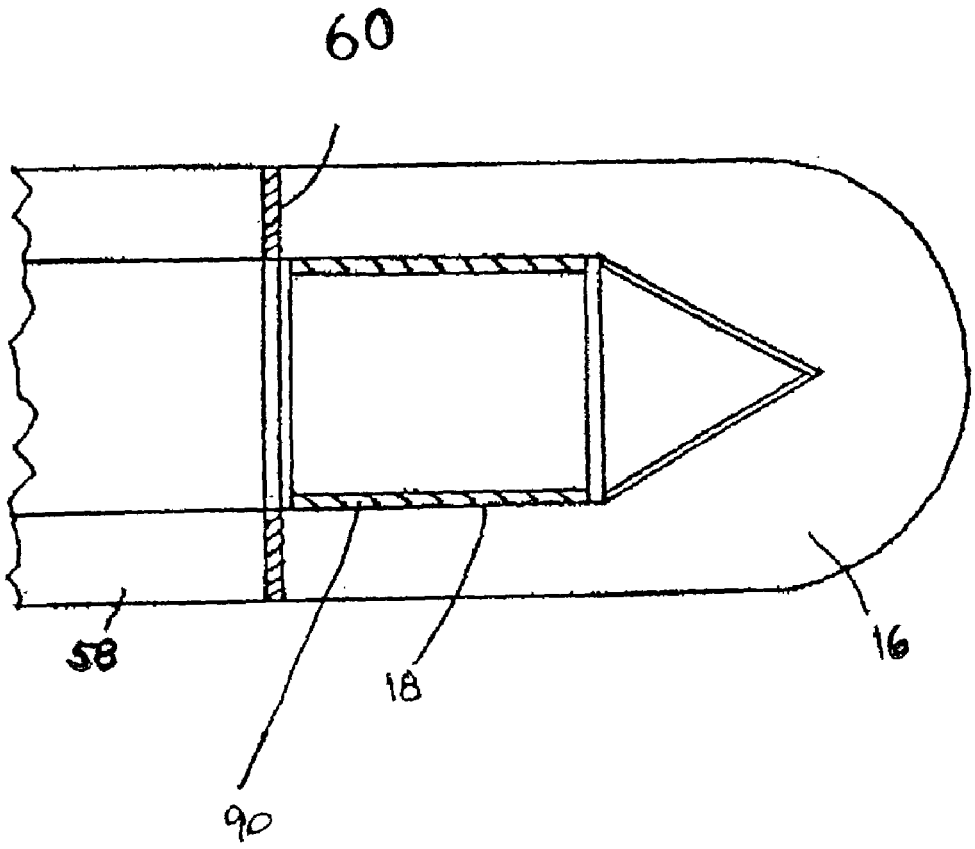
FIG. 8 is a side cross-sectional view, showing a thin film getter and its containment in the anode body.

For simplicity of construction, it may be desirable to deposit a getter material directly onto the inner surface of the x-ray tube assembly. This concept is shown in FIG. 8 where a thin film getter 90 is deposited onto the inner surface 18 of the anode body 16. The thin film getter 90 can also extend into the tube frame 58 across the anode-frame seal 60 without affecting the x-ray tube operation.

Figure 9:
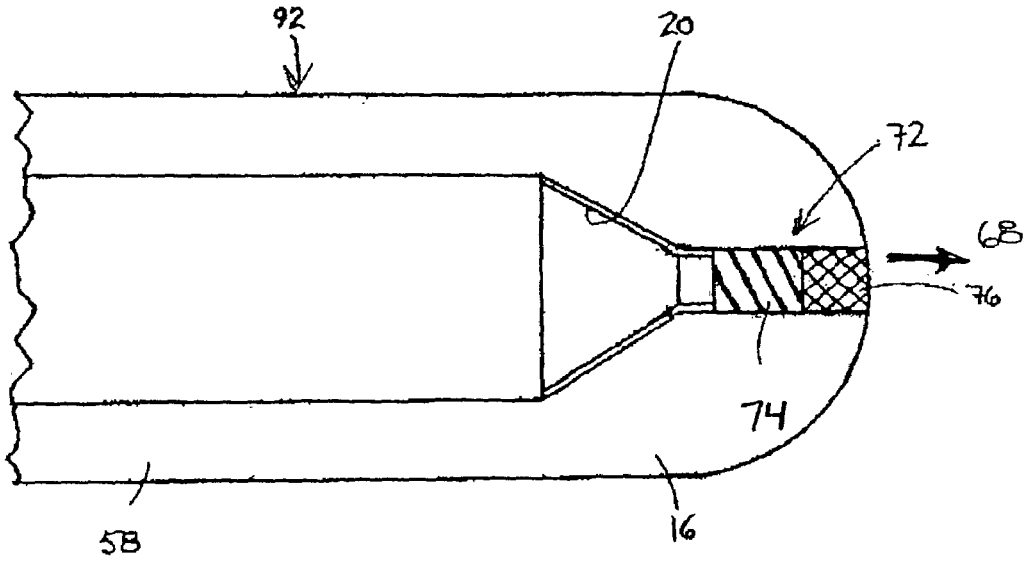
FIG. 9 is a side cross-sectional view, showing integrated tube and anode bodies in an x-ray tube of the invention.

FIG. 9 shows an embodiment in which the anode body material 16 and the tube frame 58 are an integral piece that forms the x-ray tube body 92. The advantage of this embodiment is that the anode-frame seal 60 between the anode assembly and frame shown in previous figures is eliminated and the x-ray tube assembly is simplified. In this embodiment the anode seal 72 performs several functions. If the x-ray tube body 92 is fabricated from an insulating material such as beryllium oxide, boron nitride, aluminum nitride, silicon nitride, diamond or aluminum oxide, the high Z anode plug 74 and hermetic seal 76 comprising the anode seal 72 provide electrical contact to the thin film target 20.

The high Z anode plug 74 also blocks x-ray emission along the axial direction 68. If more x-ray transmission is desired along the tube axis, a lower Z conductor may be used. An effective anode seal 72 can be achieved with only the hermetic seal 76.

The integral x-ray tube body 92 shown in FIG. 9 can be configured to contain the getter 24 shown in FIG. 1, the deposited thin film getter 90 shown in FIG. 8, or other features of the miniature x-ray source structures previously described.

Figure 10A:
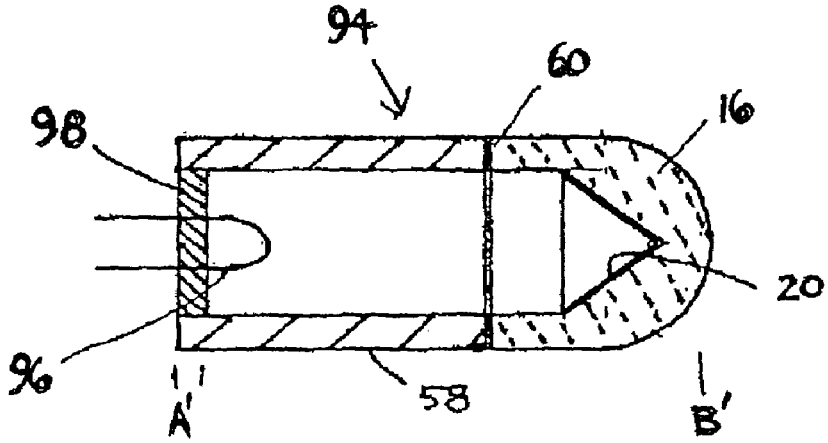
FIGS. 10A and 10B are side cross-sectional views showing embodiments of x-ray tubes of the invention, each including an anode assembly as described herein, and a cathode assembly.
Figure 10B:
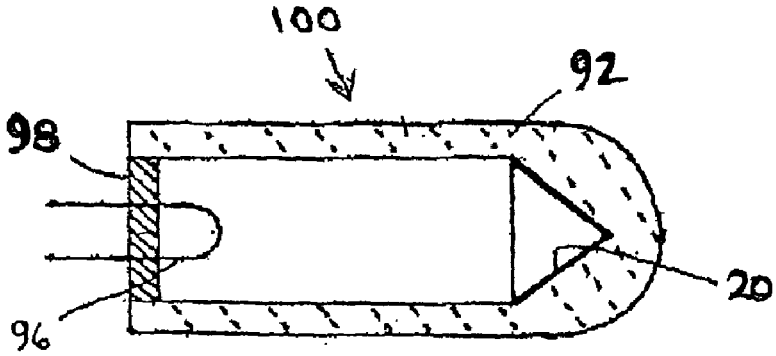

FIGS. 10A and 10B show two cross-sections of x-ray tubes comprising important embodiments of this invention. This form of the invention preferably is embodied in a miniature x-ray tube, with an external diameter on the order of about 1 mm, although similar construction can be applied to a larger tube. FIG. 10A shows a cross-section of an x-ray tube assembly 94 comprising an anode body 16 with thin film target 20 at the distal end of the x-ray tube, an anode-frame seal 60, and an x-ray tube frame 58 with cathode assembly 96 and cathode-frame seal 98, near the proximal end of the tube. The tube frame 58 defines a major portion of the length of the tube. The evacuated tube extends approximately between points A' and B' indicated on the drawing.

FIG. 10B shows a cross-section of an x-ray tube assembly 100 comprising an integral x-ray tube frame 92 with thin film target 20, at the distal end of the x-ray tube, and a cathode assembly 96 and cathode seal 98, near the proximal end of the tube. The tube extends throughout the length of the x-ray tube assembly 100, as in FIG. 10A.

Figure 11A:
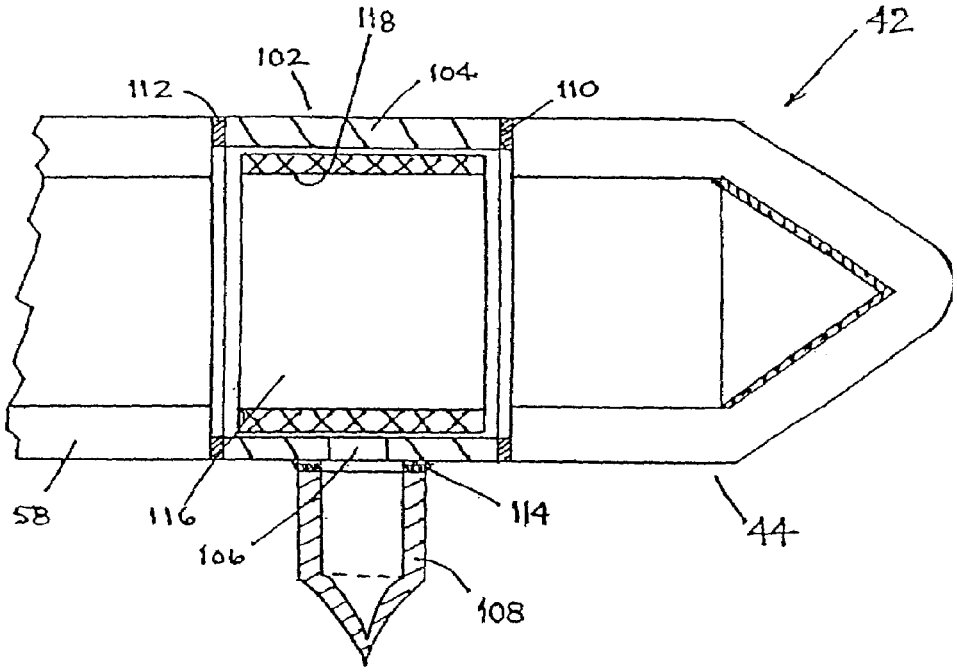
FIG. 11A is a side elevation view in cross-section, showing a portion of an x-ray tube assembly of another embodiment including a tubulation assembly.
Figure 11B:
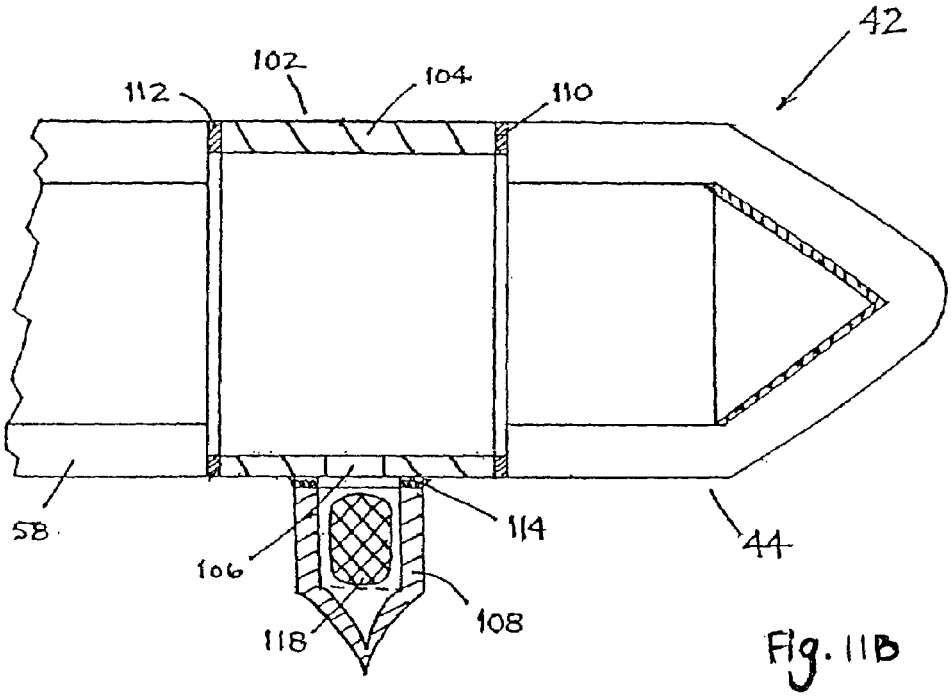
FIG. 11B is a view similar to FIG. 11A but showing a modified embodiment as to getter placement.

FIG. 11 shows in cross-section a portion of an x-ray tube assembly 42 comprising another important embodiment of this invention. An anode assembly 44 is shown at the distal end of the x-ray tube, sealed to a tubulation assembly 102 including a tubulation collar 104 with an evacuation port 106 and tubulation 108 preferably comprising copper, shown pinched off in the drawing. The anode assembly 44 is sealed to the tubulation assembly 102 at the anode-tubulation assembly seal 110. The anode-tubulation seal 110 in a preferred embodiment comprises a copper-silver active metal braze alloy. The tube frame 58 is sealed to the opposite end of the tubulation assembly 102 at frame-tubulation assembly seal 112. These seals in a preferred embodiment are achieved by brazing, using a material such as Cusil. The tubulation collar 104 may comprise a material such as Kovar, molybdenum or tantalum. Tubulation collar 104 is sealed to the tubulation 108 via the tubulation seal 114. The tubulation seal 114 in a preferred embodiment comprises Cusil or a 50% copper-50% gold alloy. As shown in this embodiment, the tubulation assembly 102 forms a getter cavity 116 to contain a getter 118. The getter 118 in a preferred embodiment may be a strip or ring. Alternatively, the getter 118 may be located within the tubulation 108 as shown in FIG. 11B.

As noted above, the x-ray tube assemblies 94 or 100 in these preferred embodiments are very small in size. The exterior diameter of the tube may be on the order of about 1 mm, and the length of the tube from cathode to anode may be about 8 or 9 mm. This provides a miniature, switchable x-ray source that can be used in lumens and other cavities of the body for administering therapeutic, very localized doses of x-rays.

The above described preferred embodiments are intended to illustrate the principles of the invention, but not to limit its scope. Other embodiments and variations to this preferred embodiment will be apparent to those skilled in the art and may be made without departing from the spirit and scope of the invention as defined in the following claims.

We claim:

1. An x-ray tube assembly, comprising:

a tube frame having an internal cavity defining a portion of the x-ray tube, assembly, a cathode assembly at one end of the tube frame for emitting electrons, an anode assembly at an opposite end of the tube frame, the anode assembly including an anode body having an internal cavity, a first end of the anode body being sealed together with said opposite end of the tube frame to form a completed x-ray tube cavity, and a second end of the anode body being formed with a conical internal surface generally coaxial with the tube frame, an x-ray generating target coated onto the conical internal surface, and the x-ray tube assembly having an external diameter not greater than 10 mm.

2. An x-ray tube assembly as in claim 1, wherein the anode body is formed of a low-Z, high thermal conductivity material.

3. An x-ray tube assembly as in claim 2, wherein the anode body is formed of any of the following: beryllium, beryllium oxide, aluminum nitride, boron nitride, silicon nitride, diamond, aluminum oxide, and composites thereof.

4. An x-ray tube assembly as in claim 2, wherein the anode body is formed of a material alloyed with aluminum or beryllium.

5. An x-ray tube assembly as in claim 1, wherein the coated target is 0.5 to 5 microns thick.

6. An x-ray tube assembly as in claim 5, wherein the target is of one or more high-Z materials.

7. An x-ray tube assembly as in claim 1, wherein the exterior of the anode assembly is rounded or bullet-shaped.

8. An x-ray tube assembly as in claim 1, wherein the exterior of the anode assembly is generally dome-shaped.

9. An x-ray tube assembly as in claim 1, wherein the exterior of the anode assembly is convoluted with ridges for increased surface area to provide for better cooling of the assembly.

10. An x-ray tube assembly as in claim 1, wherein the anode assembly includes at least one exhaust port located in the anode body.

11. An x-ray tube assembly as in claim 10, wherein a hermetic seal is formed in the exhaust port by a plug comprising one or more constituents.

12. An x-ray tube assembly as in claim 10, including a tubulation sealed to said exhaust port.

13. An x-ray tube assembly as in claim 12, wherein the anode body includes an internal getter space in fluid communication with the x-ray tube cavity, said space and tubulation together forming a getter enclosure containing a getter material, and the tubulation having an outer end which is hermetically sealed to contain a vacuum within the getter enclosure and x-ray tube cavity.

14. An x-ray tube assembly as in claim 1, wherein the anode body is joined onto the tube frame using an intermediate material.

15. An x-ray tube assembly as in claim 14, wherein the intermediate joining material comprises one of the materials Kovar, molybdenum, and tantalum.

16. An x-ray tube assembly as in claim 1, wherein the anode assembly includes at least one exhaust port, and a portion of said exhaust port forming a getter cavity within which a getter material is contained.

17. An x-ray tube assembly as in claim 1, wherein the conical surface in the anode body comprises a substantially complete cone with a closed apex.

18. An x-ray tube assembly as in claim 1, wherein the anode body includes, between the conical surface and the tube frame, an annular recess of expanded internal diameter, and an annularly-shaped getter material being fitted within said annular recess.

19. An x-ray tube assembly as in claim 1, wherein the anode body further includes a getter space generally coaxial with said conical surface and in communication with the x-ray tube cavity, with a getter material positioned within the getter space, the getter material being generally cylindrical and generally coaxially aligned with said conical surface.

20. An x-ray tube assembly as in claim 19, wherein the anode assembly includes at least one exhaust port located in the anode body.

21. An x-ray tube as in claim 20, including a tubulation sealed to said exhaust port, said tubulation forming a portion of said getter space containing the getter material.

22. An x-ray tube assembly as in claim 19, wherein the getter material is of a large size to provide significant attenuation of x-rays along the tube axis.

23. An x-ray tube assembly as in claim 1, wherein the assembly is without exhaust port or tubulation, being processed and sealed under high vacuum.

24. An x-ray tube assembly as in claim 1, wherein the anode body is formed of a graded composition, varying in properties with position in the anode body.

25. An x-ray tube assembly as in claim 1, wherein a portion of the outer surface of the anode assembly is coated with one or more materials with atomic number of ten or greater, for shaping an x-ray emission pattern.

26. An x-ray tube assembly as in claim 1, including a getter material deposited onto a portion of the interior surface of the tube frame's internal cavity.

27. An x-ray tube assembly as in claim 1, wherein the target is of electrically conductive material and serves as the anode.

28. An x-ray tube assembly as in claim 1, wherein the anode body is of electrically conductive material and said conical internal surface comprising an anode.

29. An x-ray tube assembly as in claim 1, configured to produce virtually omnidirectional x-ray emission from the anode assembly.

30. An x-ray tube assembly, comprising:

a tube frame having an internal cavity defining a portion of the x-ray tube assembly, a cathode assembly at one end of the tube frame for emitting electrons, an anode assembly at an opposite end of the tube frame, the anode assembly being integrally formed in one piece with the tube frame as one integral body and having a conical internal surface generally coaxial with the tube frame, an x-ray generating target coated onto the conical internal surface, and the x-ray tube assembly having an external diameter not greater than 10 mm.

31. An x-ray tube assembly as in claim 30, wherein the integral x-ray tube body is formed of a low-Z, high thermal conductivity material.

32. An x-ray tube assembly as in claim 30, wherein the integral x-ray tube body is formed of any of the following: beryllium oxide, aluminum nitride, boron nitride, silicon nitride, diamond, aluminum oxide, and composites thereof.

33. An x-ray tube assembly as in claim 30, wherein the coated target is 0.5 to 5 microns thick.

34. An x-ray tube assembly as in claim 30, wherein the target is of one or more high-Z materials.

35. An x-ray tube assembly as in claim 30, wherein the distal end of the integral x-ray tube body is rounded or bullet-shaped.

36. An x-ray tube assembly as in claim 30, wherein the assembly is without exhaust port or tubulation, being processed and sealed under high vacuum.

37. An x-ray tube assembly as in claim 30, wherein the distal end of the integral x-ray tube body is convoluted, with ridges.

38. An x-ray tube assembly as in claim 30, wherein the distal end of the integral x-ray tube body includes at least one exhaust port.

39. An x-ray tube assembly as in claim 38, wherein a hermetic seal is formed in the exhaust port by a plug comprising one or more constituents.

40. An x-ray tube assembly as in claim 38, including a tubulation sealed to said exhaust port.

41. An x-ray tube assembly as in claim 40, wherein the integral x-ray tube body includes an internal getter space in fluid communication with the x-ray tube cavity, said space and tubulation together forming a getter enclosure containing a getter material, and the tubulation having an outer end which is hermetically sealed to contain a vacuum within the getter enclosure and x-ray tube cavity.

42. An x-ray tube assembly as in claim 30, wherein the integral x-ray tube body includes at least one exhaust port, and a portion of said exhaust port forming a getter cavity within which a getter material is contained.

43. An x-ray tube assembly as in claim 30, wherein the conical surface in the integral x-ray tube body comprises a substantially complete cone with a closed apex.

44. An x-ray tube assembly as in claim 30, wherein the integral x-ray tube body includes, between the conical surface and the tube frame, an annular recess of expanded internal diameter, and an annularly-shaped getter material being fitted within said annular recess.

45. An x-ray tube assembly as in claim 30, wherein the integral x-ray tube body further includes a getter space generally coaxial with said conical surface and in communication with the x-ray tube cavity, with a getter material positioned within the getter space, the getter material being generally cylindrical and generally coaxially aligned with said conical surface.

46. An x-ray tube assembly as in claim 45, wherein the integral x-ray tube body includes at least one exhaust port.

47. An x-ray tube as in claim 46, including a tubulation sealed to said exhaust port said tubulation forming a portion of said getter space containing the getter material.

48. An x-ray tube assembly as in claim 45, wherein the getter material is provided with minimum diameter so as to provide minimum on-axis attenuation of x-rays.

49. An x-ray tube assembly as in claim 45, wherein the getter material is of large size to provide significant attenuation of x-rays along the tube axis.

50. An x-ray tube assembly as in claim 30, wherein the integral x-ray tube body is formed of a graded composition, varying in properties with position in the integral x-ray tube body.

51. An x-ray tube assembly as in claim 30, wherein a portion of the outer surface of the integral x-ray tube body is coated with one or more materials with atomic number of ten or greater.

52. An x-ray tube assembly, comprising:

a tube frame having an internal cavity defining a portion of the x-ray tube assembly, a cathode assembly at one end of the tube frame for emitting electrons, a tubulation assembly being sealed together with an opposite end of the tube frame to provide exhaust, the tubulation assembly having two ends, an end adjacent to the tube frame and an end opposite the tube frame, an anode assembly adjacent to the tubulation assembly at said end opposite the tube frame, the anode assembly including an anode body having an internal cavity, a first end of the anode body being sealed together with said end of the tubulation assembly opposite the tube frame to form a completed x-ray tube cavity, and a second end of the anode body being formed with a conical internal surface generally coaxial with the tube frame, and an x-ray generating target coated onto the conical internal surface.

53. An x-ray tube assembly as in claim 52, wherein the anode body is formed of a low-Z, high thermal conductivity material.

54. An x-ray tube assembly as in claim 53, wherein the anode body is formed of any of the following: beryllium, beryllium oxide, aluminum nitride, boron nitride, silicon nitride, diamond, aluminum oxide, and composites thereof.

55. An x-ray tube assembly as in claim 53, wherein the anode body is formed of a material alloyed with aluminum or beryllium.

56. An x-ray tube assembly as in claim 53, wherein the target coating is 0.5 to 5 microns thick.

57. An x-ray tube assembly as in claim 56, wherein the target comprises one or more high-Z materials.

58. An x-ray tube assembly as in claim 52, wherein the exterior of the anode assembly is rounded or bullet-shaped.

59. An x-ray tube assembly as in claim 52, wherein the exterior of the anode assembly is convoluted with ridges for increased surface area to provide for better cooling of the assembly.

60. An x-ray tube assembly as in claim 52, wherein the anode body includes an internal getter space in fluid communication with the x-ray tube cavity, said space and tubulation together forming a getter enclosure containing a getter material, and the tubulation having an outer end which is hermetically sealed to contain a vacuum within the getter enclosure and x-ray tube cavity.

61. An x-ray tube assembly as in claim 52, wherein the conical surface in the anode body comprises a substantially complete cone with a closed apex.

62. An x-ray tube assembly as in claim 52, wherein the anode body includes, between the conical surface and the tube frame, an annular recess of expanded internal diameter, and an annularly-shaped getter material being fitted within said annular recess.

63. An x-ray tube assembly as in claim 52, wherein the anode body is formed of a graded composition, varying in properties with position in the anode body.

64. An x-ray tube assembly as in claim 52, wherein a portion of the outer surface of the anode assembly is coated with one or more materials with atomic number of ten or greater, for shaping an x-ray emission pattern.

65. An x-ray tube assembly as in claim 52, including a getter material deposited onto a portion of the interior surface of the tube frame's internal cavity.

66. An x-ray tube assembly as in claim 52, wherein the target is of electrically conductive material and serves as the anode.

67. An x-ray tube assembly as in claim 52, wherein the anode body is of electrically conductive material and said conical internal surface comprising an anode.

* * * * *